US011918924B2

(12) United States Patent
Loudon et al.

(10) Patent No.: US 11,918,924 B2
(45) Date of Patent: Mar. 5, 2024

(54) CAROUSEL RIDE SYSTEMS

(71) Applicant: Universal City Studios LLC, Universal City, CA (US)

(72) Inventors: Jerrell Andrew Loudon, Orlando, FL (US); Rick A Dias, Saint Cloud, FL (US); David Wayne Komives, Rockledge, FL (US); William Dale Mason, Camano Island, WA (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 18/111,757

(22) Filed: Feb. 20, 2023

(65) Prior Publication Data

US 2023/0191266 A1 Jun. 22, 2023

Related U.S. Application Data

(62) Division of application No. 17/366,411, filed on Jul. 2, 2021, now Pat. No. 11,583,780.

(Continued)

(51) Int. Cl.

| | |
|---|---|
| ***A63G 1/08*** | (2006.01) |
| ***A63G 1/26*** | (2006.01) |
| *A63H 13/20* | (2006.01) |

(52) U.S. Cl.

CPC ..... *A63G 1/08* (2013.01); *A63G 1/26* (2013.01)

(58) Field of Classification Search

CPC ..... A63H 3/28; A63H 13/00; A63H 13/20; A63G 1/02; A63G 1/08; A63G 1/26; A63G 1/30

(Continued)

(56) References Cited

U.S. PATENT DOCUMENTS 5,314,365 A * 5/1994 Chen ..... A63H 13/20 446/299
5,906,870 A * 5/1999 Lo ..... A63H 13/20 428/542.2

(Continued)

FOREIGN PATENT DOCUMENTS

DE 487835 C 12/1929
DE 1780962 U 1/1959

(Continued)

OTHER PUBLICATIONS

Mad Tea Party; https://en.wikipedia.org/w/index.phptitle=Mad_Tea_Party oldid=932604459; Dec. 27, 2019.

(Continued)

*Primary Examiner* — Kien T Nguyen
(74) *Attorney, Agent, or Firm* — Fletcher Yoder, PC

(57) ABSTRACT

A carousel ride system includes a first rotatable platform and multiple second rotatable platforms. Each second rotatable platform of the multiple second rotatable platforms is positioned within a respective opening in the first rotatable platform. A first drive system is configured to drive rotation of the first rotatable platform and multiple second drive assemblies are configured to drive rotation of the multiple second rotatable platforms. Multiple figures extend over the multiple second rotatable platforms and multiple figure drive assemblies are configured to independently lift and rotate the multiple figures relative to the multiple second rotatable platforms. One or more processors are configured to coordinate operation of the first drive system, the multiple second drive assemblies, and the multiple figure drive assemblies to maintain the multiple figures in a forward-facing orientation relative to a direction of travel of the first rotatable platform during operation of the carousel ride system.

15 Claims, 6 Drawing Sheets

Related U.S. Application Data

(60) Provisional application No. 63/050,908, filed on Jul. 13, 2020.

(58) Field of Classification Search
USPC ..... 472/29–35, 45–47; 446/175, 299
See application file for complete search history.

(56) References Cited

U.S. PATENT DOCUMENTS

| | | | | |
|---|---|---|---|---|
| 6,204,439 | B1 * | 3/2001 | Chen | G10F 1/06 84/95.2 |
| 6,322,677 | B1 | 11/2001 | Woodruff et al. | |
| 9,610,511 | B1 | 4/2017 | Francis et al. | |
| 2003/0087582 | A1 * | 5/2003 | Chen | A63H 5/00 446/175 |
| 2013/0130812 | A1 | 5/2013 | Burger | |
| 2013/0255530 | A1 * | 10/2013 | Willcox | A63G 1/26 104/75 |
| 2014/0261052 | A1 | 9/2014 | Baxter et al. | |

FOREIGN PATENT DOCUMENTS

| | | | |
|---|---|---|---|
| DE | 2202355 | A1 | 9/1973 |
| EP | 2422856 | B1 | 10/2016 |

OTHER PUBLICATIONS

The Tea Cup Ride; Mack Rides GmbH Co KG; 2017.
PCT/US2021/040724 Invitation to Pay Additional Fees dated Oct. 27, 2021.

* cited by examiner

CAROUSEL RIDE SYSTEMS

CROSS-REFERENCE TO RELATED APPLICATION

This application is a division of U.S. Non-Provisional application Ser. No. 17/366,411, entitled "CAROUSEL RIDE SYSTEM," filed Jul. 2, 2021, which claims priority to and the benefit of U.S. Provisional Application No. 63/050,908, entitled "CAROUSEL RIDE SYSTEM," filed Jul. 13, 2020, which are hereby incorporated by reference in their entirety for all purposes.

BACKGROUND

Amusement parks may have various entertainment attractions. One type of entertainment attraction may be a carousel ride system. The carousel ride system may include a turntable and multiple figures (e.g., seats for riders) that rotate with the turntable. In some carousel ride systems, the multiple figures may move up and down relative to the turntable as the multiple figures rotate with the turntable.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

Certain embodiments commensurate in scope with the originally claimed subject matter are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

In an embodiment, a carousel ride system includes a first rotatable platform and multiple second rotatable platforms. Each second rotatable platform of the multiple second rotatable platforms is positioned within a respective opening in the first rotatable platform. A first drive system is configured to drive rotation of the first rotatable platform and multiple second drive assemblies are configured to drive rotation of the multiple second rotatable platforms. Multiple figures extend over the multiple second rotatable platforms and multiple figure drive assemblies are configured to independently lift and rotate the multiple figures relative to the multiple second rotatable platforms. One or more processors are configured to coordinate operation of the first drive system, the multiple second drive assemblies, and the multiple figure drive assemblies to maintain the multiple figures in a forward-facing orientation relative to a direction of travel of the first rotatable platform during operation of the carousel ride system..

In an embodiment, a drive system for a carousel ride system includes multiple figure drive assemblies configured to independently lift and rotate multiple figures of the carousel ride system. Each figure drive assembly of the multiple figure drive assemblies includes a rotation assembly having a rotation motor supported on a rotation base, a bracket coupled to the rotation base and slidingly coupled to a support post, and a sleeve coupled to the bracket and configured to couple to a pole of a respective figure of the multiple figures. Each of the multiple figure drive assemblies also includes a lift assembly having a lift motor supported on a lift base and a threaded shaft coupled to the lift base and extending through a threaded opening of the bracket. Operation of the rotation motor is configured to drive rotation of the sleeve and operation of the lift motor is configured to lift the rotation assembly.

In an embodiment, a method of operating a carousel ride system includes driving rotation of a first rotatable platform about a first rotational axis using a first drive system positioned between the first rotatable platform and a ground relative to a vertical axis. The method also includes driving rotation of multiple second rotatable platforms about respective second rotational axes using multiple second drive assemblies, wherein each second drive assembly of the multiple second drive assemblies is positioned between a respective one of the multiple second rotatable platforms and the ground relative to the vertical axis. The method further includes driving rotation and lift of multiple figures that extend over the multiple second rotatable platforms using multiple figure drive assemblies positioned between the multiple second rotatable platforms and the ground relative to the vertical axis and in a coordinated manner to maintain the multiple figures in a forward-facing orientation relative to a direction of travel of the first rotatable platform during operation of the carousel ride system.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
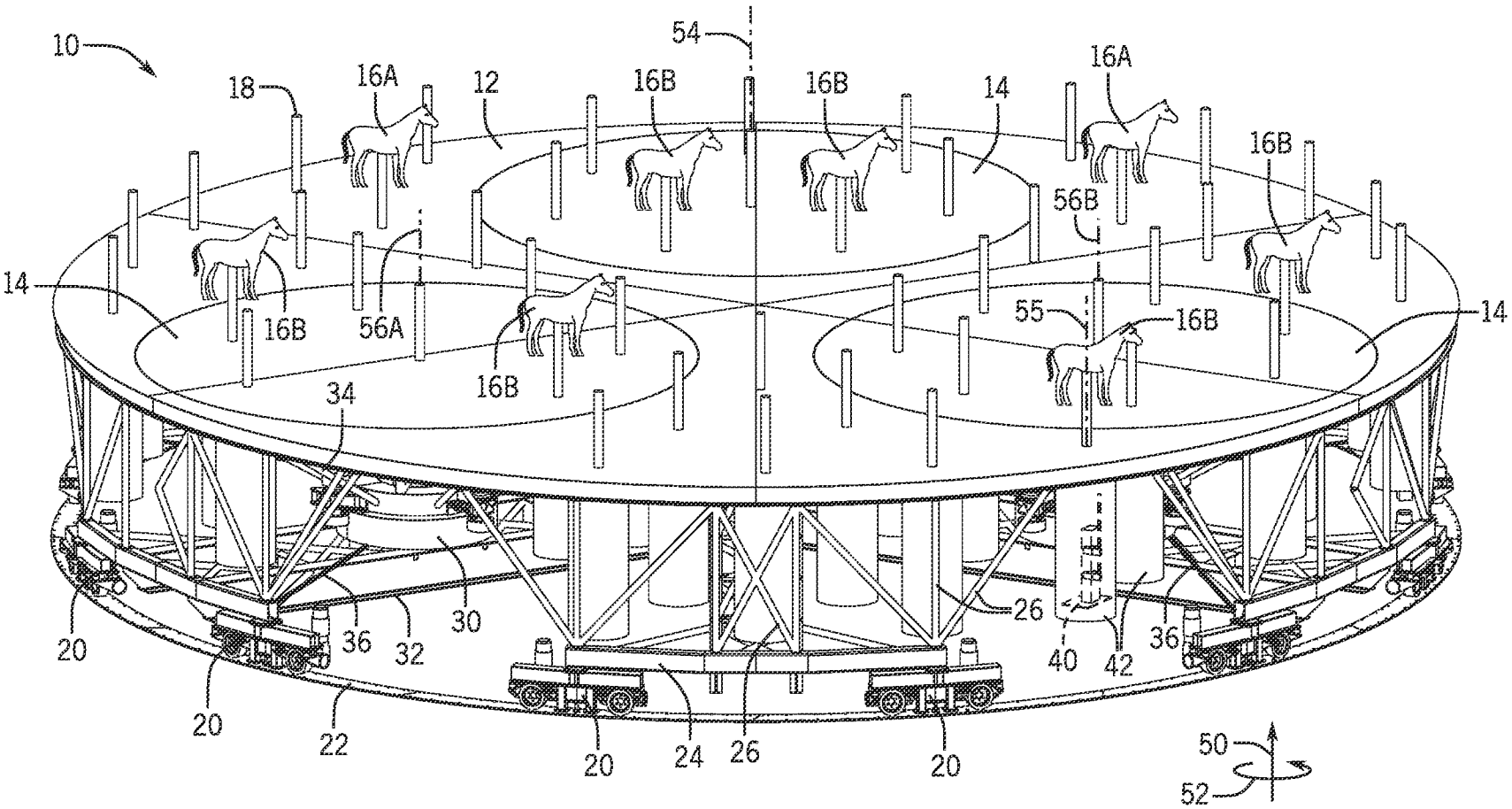
FIG. 1 is a perspective view of an embodiment of a carousel ride system that includes multiple first platform drive assemblies, multiple second platform drive assemblies, and multiple figure drive assemblies, in accordance with an embodiment of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. One or more specific embodiments of the present embodiments described herein will be described below. In an effort to provide a concise description of these embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

The present disclosure is related to a carousel ride system that may be used in an amusement park. The carousel ride system may include a first platform (e.g., first rotatable platform), multiple second platforms (e.g., second rotatable platforms), and multiple figures (e.g., seats for riders). The figures may move up and down relative to the first platform as the figures rotate with the first platform. At least some of the figures may also rotate with a respective second platform. In an embodiment, each figure may lift (e.g., move up and down) and rotate independently from one another while maintaining a consistent forward-facing orientation to improve ride entertainment and/or comfort, for example.

In an embodiment, carousel ride operations may be programmable so that different operational modes can be performed during ride operation. For instance, some figures may lift and/or rotate, while other figures may not lift and/or rotate. In an embodiment, one or more groups of figures may lift and/or rotate in a coordinated manner, such as to provide a group of riders (e.g., a family) a racing-type experience, to face toward one another at certain times or throughout ride operation, or the like. Such operational modes may further enhance the ride experience.

With the foregoing in mind, FIG. 1 is a perspective view of an embodiment of a carousel ride system 10 that includes a first platform 12 (e.g., first rotatable platform), multiple second platforms 14 (e.g., second rotatable platforms), and multiple FIGS. 16 (e.g., seats for riders) each mounted on a respective pole 18 (e.g., rigid support pole). As shown, a first set of the FIGS. 16, such as FIGS. 16A, are positioned on the first platform 12 and may move up and down relative to the first platform 12 as the FIGS. 16A rotate with the first platform 12. A second set of the FIGS. 16, such as FIGS. 16B, are each positioned on a respective second platform 14 and may move up and down relative to the respective second platform 14 as the FIG. 16B rotates with the respective second platform 14. Because the second platforms 14 are supported within openings formed in the first platform 12 and/or are carried to rotate with the first platform 12, it should be appreciated that each of the figures (e.g., FIGS. 16A and 16B) may rotate with the first platform 12 and may move up and down relative to the first platform 12 and/or the second platform 14. Additionally, each of the FIGS. 16 (e.g., FIGS. 16A and 16B) may lift and rotate independently from one another via a respective pole 18 while rotating with the first platform 12 and/or a respective second platform 14.

The first platform 12 may be a rotatable platform or table supported and driven by a first platform drive system (e.g., unified first platform drive system), which may include multiple first platform drive assemblies 20 that are located under the first platform 12. The first platform drive system, which may include the first platform drive assemblies 20, may drive the first platform 12 to rotate about a first rotational axis 54 that passes through a center of the first platform 12 and that may be parallel to a vertical axis 50. For example, as shown, the first platform drive assemblies 20 may be positioned underneath the first platform 12 (e.g., between the first platform 12 and the ground; underneath a radially-outer edge portion of the first platform 12), and the first platform drive assemblies 20 may be arranged circumferentially about the first rotational axis 54.

In the illustrated embodiment of FIG. 1, six first platform drive assemblies 20 may be used to support and drive the first platform 12 to move on a rail 22 (e.g., track, path) in a circumferential direction 52. The rail 22 may be a circular track positioned on a base (e.g., ground; steel-reinforced concrete slab). Each of the first platform drive assemblies 20 may include physically-separate drive units. For example, as shown in FIG. 1, each of the first platform drive assemblies 20 includes two physically-separate drive units. It should be appreciated that any of a variety of different drive assembly configurations (e.g., more or less than six first platform drive assemblies, each having more or less than two drive units) may be implemented. However, multiple first platform drive assemblies 20 that each have multiple drive units may advantageously enable the carousel ride system 10 to continue to operate and drive rotation of the first platform 12 even after one or a portion of the drive assemblies 20 fail.

As illustrated, the drive units in each first platform drive assembly 20 may be connected by a connection beam 24. Each first platform drive assembly 20 may be connected to the first platform 12 by one or more support beams 26. The use of multiple first platform drive assemblies 20 along with the multiple connection beams 24 and multiple support beams 26 may help to distribute weight (e.g., of the first platform 12, the second platforms 14, the FIGS. 16, riders) across the rail 22 and the base.

The multiple second platforms 14 may be a set of rotatable platforms or tables supported and driven by respective second platform drive assemblies 30. As shown, a single second platform drive assembly 30 may be located under a respective second platform 14 and may be used to support and drive the respective second platform 14. Each second platform drive assembly 30 may drive the respective second platform 14 to rotate about a respective second rotational axis (e.g., second rotational axis 56A or 56B of a corresponding second platform 14) and that may be parallel to the vertical axis 50 and/or the first rotational axis 54.

As illustrated, each second platform drive assembly 30 may be positioned on a radially-extending beam 32 (e.g., spoke). In an embodiment, each radially-extending beam 32 may include one or more rods that extend radially between a respective connection beam 24 and a center post located under the first platform 12. Each radially-extending beam 32 may be fixed to (e.g., non-rotatable with respect to) the respective connection beam 24 and the center post (e.g., the center post may rotate relative to the ground), or each radially-extending beam 32 may be fixed to the respective connection beam 24 and may be rotatably coupled to (e.g., rotatable with respect to) the center post (e.g., the center post may be stationary relative to the ground). Each second platform drive assembly 30 may be connected to a respective second platform 14 by one or more support beams 34. Additionally, each second platform drive assembly 30 may be connected to a respective first platform drive assembly 20 by one or more additional connection beams 36. As shown, the second platform drive assemblies 30 may be positioned underneath the respective second platform 14 (e.g., between the respective second platform 14 and the ground; underneath a center portion of the respective second platform 14), and the second platform drive assemblies 30 may be radially-inwardly of the first platform drive assemblies 20 (e.g., between the first platform drive assemblies 20 and the center post).

Each second platform 14 may be positioned within a respective platform opening in the first platform 12. In an embodiment, each second platform 14 is not supported by the first platform 12, and is instead fully supported by its second platform drive assembly 30 and associated structures (e.g., the radially-extending beam 32) located underneath the first platform 12 and/or the second platform 14. In an embodiment, a radial gap is provided between a radially-outer surface of the second platform 14 and a radially-inner surface that defines the respective platform opening. In such cases, roller bearings may be provided within the radial gap to facilitate rotation of the second platform 14 relative to the first platform 12. It should also be appreciated that the second platforms 14 may be at least partially supported on the first platform 12, or the first platform 12 may be at least partially supported on the second platforms 14.

Each of the multiple FIGS. 16 may be mounted on a corresponding pole 18. The poles 18 may not extend upward above the FIGS. 16 and/or may not be attach to a ceiling or other structure above the FIGS. 16. During loading and unloading operations of the carousel ride system 10, the carousel riders may travel (e.g., walk) on the first platform 12 and/or the second platform 14 to reach the multiple FIGS. 16. Each pole 18 may extend through a respective opening (e.g., pole opening) in the first platform 12 or one of the second platforms 14. In some cases, at least a portion of the FIG. 16 may extend through the respective opening along with the pole 18, for example. Thus, at least the portion of the FIG. 16 may be positioned below the first platform 12 or one of the second platforms 14 relative to the vertical axis 50 (e.g., between the first platform 12 or one of the second platforms 14 and the ground). It should be appreciated that each pole 18 may be positioned so that at least a portion of the FIG. 16 attached thereto extends over at least one of the first platform 12 or the second platforms 14.

The first platform 12 and the second platforms 14 may be carried to travel together about the first rotational axis 54. Thus, operation of the first platform drive assemblies 20 to drive rotation of the first platform 12 about the first rotational axis 54 may result in rotation of the multiple FIGS. 16A positioned on the first platform 12 and the multiple FIGS. 16B positioned on the second platforms 14 about the first rotational axis 54. Additionally, rotation of each second platform 14 about a respective rotational axis (e.g., second rotational axis 56A or 56B of the second platform 14) may drive rotation of corresponding multiple FIGS. 16B positioned on the second platform 14 about the respective second rotational axis 56A or 56B. To facilitate discussion and image clarity, only some of the multiple FIGS. 16 and corresponding components (e.g., pole 18) are illustrated in FIG. 1. However, it should be appreciated that the multiple FIGS. 16 and corresponding components may be distributed at various locations about the first platform 12 and the second platforms 14. The first platform 12 and the second platforms 14 may rotate at the same or different rotational rates and/or in the same or different directions (e.g., in the circumferential direction 52 or in a direction opposite the circumferential direction 52). Additionally, the second platforms 14 may rotate at the same or different rotational rates and/or in the same or different directions as compared to one another. Furthermore, the rotational rates and/or the directions may vary throughout the ride operation.

As mentioned previously, each of the multiple FIGS. 16 may be supported and driven, via a respective pole 18, by a figure drive assembly 40 (e.g., lift and rotate system or assembly). The figure drive assembly 40 may be supported by and/or concealed inside a housing unit 42 that is located under the first platform 12 and/or a respective second platform 14. Each housing unit 42 may be attached (e.g., mounted, such as via one or more fasteners) to a bottom side of the first platform 12 or the respective second platform 14, and thus, the figure drive assemblies 40 are positioned underneath the first platform 12 or the respective second platform 14 (e.g., between the first platform 12 or the respective second platform 14 and the ground). In this way, the housing unit 42 may support and carry the figure drive assembly 40 with the first platform 12 or the respective second platform 14. The housing unit 42 may also provide protection for the figure drive assembly 40 from dirt, moisture, accidental contact, or the like.

Each figure drive assembly 40 may drive a corresponding FIG. 16 to move up and down along a respective figure axis 55 (e.g., parallel to the respective pole 18, the vertical axis 50, the first rotational axis 54, and/or the second rotational axis 56A or 56B). Each figure drive assembly 40 may also drive the corresponding FIG. 16 to rotate about the respective figure axis 55. The figure drive assembly 40 may increase the operational flexibility of the carousel ride system 10, thus enriching the ride experience for riders.

During ride operations, at least the first platform 12, a respective center of each of the second platforms 14, the multiple FIGS. 16A, the first platform drive assemblies 20, and a respective center of each of the second platform drive assemblies 30 may rotate together in the circumferential direction 52. During this rotation, the multiple FIGS. 16 may move up and down along the figure axes 55. In an embodiment, the multiple FIGS. 16 may also rotate about the figure axes 55. The multiple FIGS. 16 may move up and down at the same or different lift rates, may move up and down through the same or different lift heights (e.g., relative to the first platform 12 or the respective second platform 14), may rotate at the same or different rotational rates, and/or may rotate in the same or different directions (e.g., in the circumferential direction 52 or in a direction opposite the circumferential direction 52) as compared to one another. Furthermore, the lift rates, the lift heights, the rotational rates, and/or the directions may vary throughout the ride operation.

A variety of support and drive assemblies, systems, or components may be generally hidden from the view of the riders. For example, the first platform drive assemblies 20, the rail 22, the connection beams 24, the support beams 26, the second platform drive assemblies 30, the radially-extending beams 32, the support beams 34, the additional connection beams 36, the figure drive assemblies 40, and at least a portion of each pole 18 may be positioned vertically below the first platform 12 and/or the multiple second platforms 14, enclosed by a cover (e.g., wall), and/or positioned within a receptacle (e.g., opening or hole) formed in the ground. Thus, as the riders approach the carousel ride system 10, travel across the first platform 12, and the multiple second platforms 14 during loading and unloading operations, and ride on the multiple FIGS. 16 during ride operations, the riders may not see the variety of support and drive assemblies, systems, or components mentioned above, the cover, and/or the ground surrounding the receptacle. While at least some portions of the hidden features are shown as generally transparent to facilitate discussion and to enable visualization of components of the carousel ride system 10, it should be appreciated that at least some portions of such hidden features may not be transparent.

Figure 2:
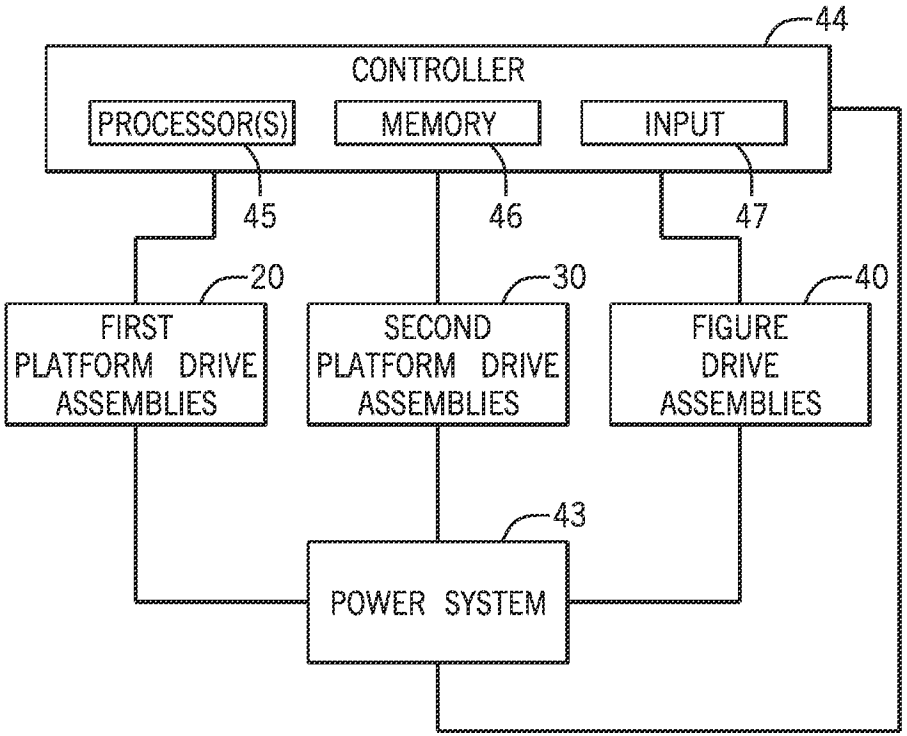
FIG. 2 is a block diagram of a power system and a controller that may be used in the carousel ride system of FIG. 1, in accordance with an embodiment of the present disclosure.

Additionally, it should be appreciated that various drive assemblies described in preceding sections may be powered, controlled, and coordinated by a power system and a control system (e.g., electronic control system). For example, with reference to FIG. 2, a power system 43 and a controller 44 may be used in the carousel ride system 10. The power system 43 and the controller 44 may be positioned under the first platform 12 and the second platforms 14, being generally hidden from the view of the riders. However, the power system 43 and the controller 44 may be positioned in any suitable location. The power system 43 may provide electrical power for operating the various drive assemblies, including the first platform drive assemblies 20, the second platform drive assemblies 30, the figure drive assemblies 40, and so on. The controller 44 may control and coordinate the operations of the various drive assemblies mentioned above, and/or the operations of the power system 43. For example, the controller 44 may control, via the second platform drive assemblies 30 and the figure drive assemblies 40, orientations of the FIGS. 16 so that the riders riding on the FIGS. 16 (e.g., FIGS. 16B that may rotate with a corresponding second platform 14 in addition to rotating with the first platform 12 during ride operations) may consistently face forward (e.g., in the circumferential direction 52; in a direction of travel of the first platform 12) while each of the FIGS. 16 are lifting and rotating individually.

In an embodiment, the FIGS. 16 (e.g., all FIGS. 16 or a group of FIGS. 16, such as all FIGS. 16 that rotate with one of the second platforms 14) may lift and/or rotate in a coordinated manner, such as to provide a group of riders (e.g., a family) a racing-type experience, to face toward one another at certain times or throughout ride operation, or the like. For example, as the first platform 12 rotates about its first rotational axis 54 and the second platform 14 rotates about its second rotational axis 56, a first FIG. 16 on the second platform 14 may move forward of the other FIGS. 16 on the second platform 14, then the first FIG. 16 on the second platform 14 may move rearward relative to the other figures on the second platform 14 as a second FIG. 16 on the second platform 14 moves forward of the other FIGS. 16 on the second platform 14, and so on. Thus, the riders may have a racing-type experience throughout ride operations. The controller 44 may control the figure drive assemblies 40 to consistently face forward and/or so that the FIGS. 16 are raised as they move forward of the other FIGS. 16 on the second platform 14 (e.g., reach a peak at a forward-most position or while in front of the other FIGS. 16) and so that the FIGS. 16 are lowered as they move rearward of the other figures on the second platform 14 (e.g., reach a valley at a rearward-most position or while behind the other FIGS. 16) to enhance the racing-type experience.

As illustrated, the controller 44 may include one or more processors 45, a memory device 46, and an input device 47. The processor(s) 45 may provide control signals to certain controllable devices and components (e.g., motors, actuators, brakes, or the like) associated with the various drive assemblies (e.g., the first platform drive assemblies 20, the second platform drive assemblies 30, and the figure drive assemblies 40) and other relevant assemblies/systems. The processor(s) 45 may be configured to receive inputs via an input device 47 (e.g., from a ride operator; from a rider; from another device) and to provide the control signals to the controllable devices and components in response to the inputs. For example, the processor(s) 45 may receive an input that indicates that the riders have climbed onto the multiple FIGS. 16 and that a loading operation is complete. In response, the processor(s) 45 may provide control signals to the first platform drive assemblies 20, the second platform drive assemblies 30, and the figure drive assemblies 40 to initiate new ride operations. In an embodiment, the processors(s) 45 may receive an input (e.g., prior to the ride or during the ride, such as via an input device on the FIG. 16) that indicates a characteristic and/or a preference of a rider of a particular figure, such as a characteristic and/or preference related to a lift rate, a lift height, a rotational rate, and/or a rotational direction for the FIG. 16. In response, the processor(s) 45 may provide control signals to the respective figure drive assembly 40 to adjust the FIG. 16 in accordance with the characteristic and/or preference (e.g., a higher lift rate, a lift height and/or a rotational rate for an adult, and a lower lift rate, a lift height, and/or rotational rate for a child). In an embodiment, the processor(s) 45 may receive an input from another device (e.g., computing system), such as an input related to achievements of the rider in the amusement park, such as a number of points earned in a game, a number of rides completed, purchases made, or the like. In response, the processor(s) 45 may provide control signals to the respective figure drive assembly 40 to adjust the FIG. 16 in accordance with the achievements (e.g., a higher lift rate, a lift height and/or a rotational rate for a first rider with more achievements, and a lower lift rate, a lift height, and/or rotational rate for a second rider with fewer achievements). In an embodiment, the processor(s) 45 may receive an input (e.g., from a rider(s) in a group of riders; prior to the ride or during the ride) that indicates a group preference, such as selection of one of multiple group movements for the FIGS. 16B on a respective one of the second platforms 14 (e.g., face forward for a racing experience, face toward one another for a family experience). In response, the processor(s) 45 may provide control signals to the respective figure drive assemblies 40 to adjust the FIGS. 16B in a coordinated manner to provide the selected group movement. Any combination of inputs and corresponding control features may be implemented.

In operation, the carousel ride system 10 may continuously move between loading operations, ride operations, and unloading operations. Certain operations (e.g., ride operations) may be automated and/or controlled on one or more timers (e.g., timed schedules). For example, once rotation of the first platform 12 commences, rotations of the second platforms 14 may commence simultaneously or with a delay time. The rotation of the first platform 12 may continue for a time period (e.g., predetermined or operator-controlled time period, such as 1, 2, 3, 4, 5, or more minutes). The rotations of the second platforms 14 may continue for the same or a different time period. When the time period of the first platform 12 ends, the processor(s) 45 may provide the control signals to the controllable devices and components (e.g., motors, actuators, brakes, or the like) of the first platform 12, the second platforms 14, and the FIGS. 16 to stop movement (e.g., rotations and/or lifts) simultaneously or in a predetermined time sequence.

The memory device 46 may include one or more tangible, non-transitory, computer-readable media that store instructions executable by the processor(s) 45. For example, the memory device 46 may include random access memory (RAM), read only memory (ROM), rewritable non-volatile memory such as flash memory, hard drives, optical discs, and/or the like. Additionally, the processor(s) 45 may include one or more general purpose microprocessors, one or more application specific processors (ASICs), one or more field programmable gate arrays (FPGAs), or any combination thereof.

Additionally or alternatively, individual (or distributed) controllers may be implemented. For example, the first platform drive assemblies 20, the second platform drive assemblies 30, the figure drive assemblies 40, and/or the power system 43 may have dedicated controllers (to be described in detail later) respectively. The dedicated controllers may be communicatively connected to the controller 44. The controller 44 may control and coordinate, via the respective dedicated controllers, the operations of the first platform drive assemblies 20, the second platform drive assemblies 30, the figure drive assemblies 40, and/or the power system 43.

Figure 3:
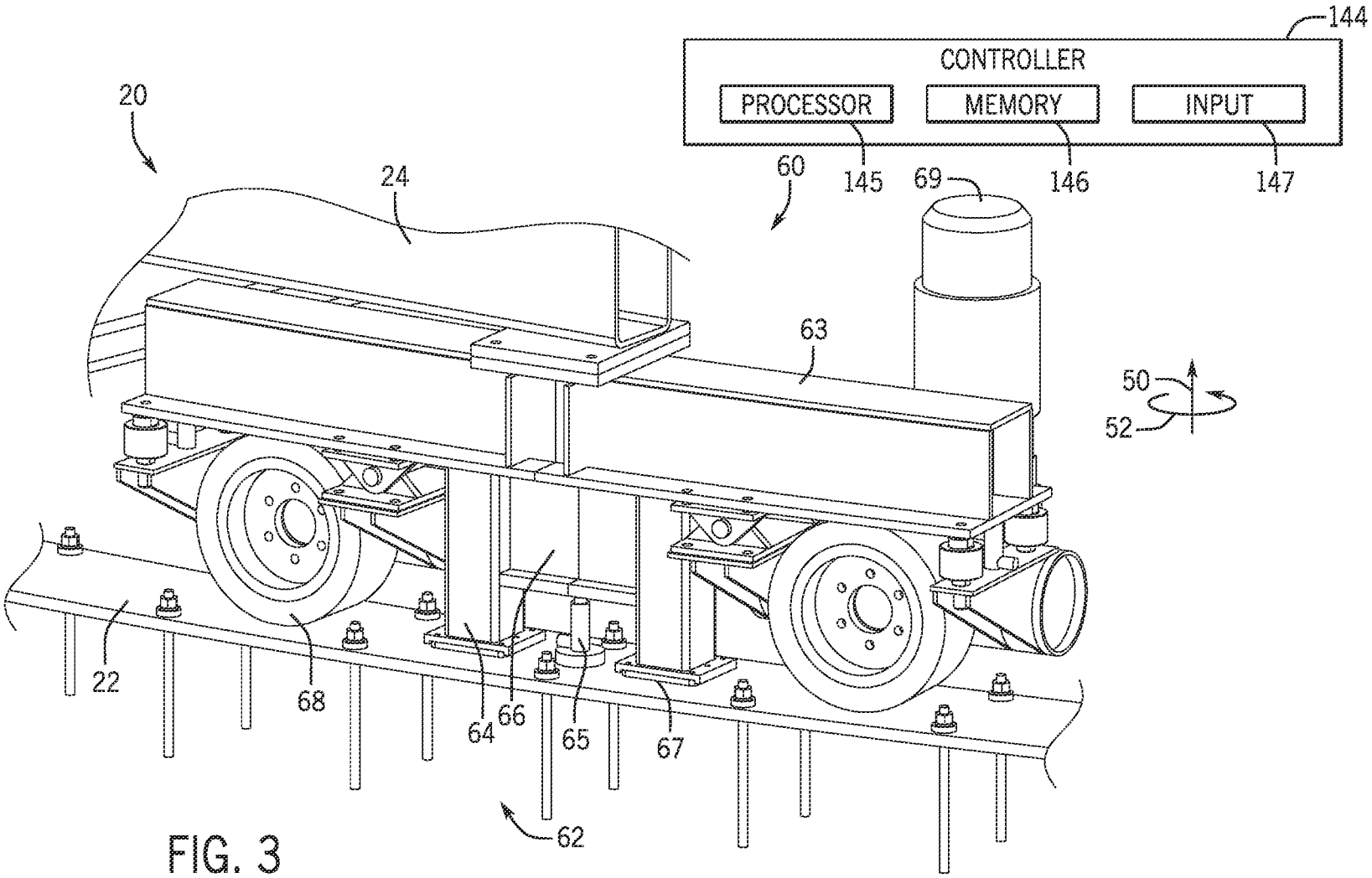
FIG. 3 is a perspective view of a portion of one of the first platform drive assemblies of FIG. 1, in accordance with an embodiment of the present disclosure.

FIG. 3 is a perspective view of a portion of one of the first platform drive assemblies 20, as described in FIG. 1. For example, the portion of the first platform drive assembly 20 shown here may be a drive unit 60, which is one of the two separated drive units in the configuration described previously. The drive unit 60 may be used to drive the first platform 12 to rotate about a center axis of the first platform drive assemblies 20 (e.g., the first rotational axis 54). The drive unit 60 may be used to support and drive the first platform 12 to move on the rail 22 in the circumferential direction 52. The rail 22 may be secured on a base using mounting bolts and/or other fasteners, for example.

As illustrated, the drive unit 60 may be connected to another drive unit in the same first platform drive assembly 20 by the connection beam 24. The drive unit 60 may include a frame assembly 62, one or more drive wheels 68, and a drive motor 69. The frame assembly 60 may provide support for the connection beam 24. Additionally, the frame assembly 62 may provide mounting points for the drive wheel(s) 68 and the drive motor 69. The drive motor 69 may be any type of electrical motor that generates rotational force used to drive the drive wheel(s) 68 to rotate. Although not shown here, the drive unit 60 may include other components, such as one or more brake units, one or more biasing members, one or more gearboxes, and the like.

The frame assembly 62 may include a frame 63, one or more support beams 64, and a jack 65. The frame 63 may provide direct support for the connection beam 24. The support beams 64 may be coupled to (e.g., vertically suspended from) the frame 63. The support beams 64 may be connected horizontally via a bracket 66. The support beams 64 may or may not contact the surface of the rail 22 during ride operations. The jack 65 may be coupled to (e.g., vertically suspended from) a bottom of the bracket 66).

In an embodiment, the support beams 64, or a portion (e.g., bottom portion) of the support beams 64, may be made of certain metal or plastic material that has specific abrasion and resistance properties. For example, ultra-high molecular weight (UHMW) polyethylene, which has high abrasion and impact resistance properties, may be used in the support beams 64. In the cases where the support beams 64 may contact the surface of the rail 22 during ride operations to support the frame 63 and other components, the support beams 64 (e.g., made of the UHMW polyethylene or other suitable material) may resist wear, friction, and corrosion, thus reducing maintenance cost (e.g., with less power consumption) and extending equipment/component life.

In an embodiment, a gap 67 (e.g., along the vertical axis 50) may be provided between the support beams 64 and a top surface of the rail 22 (e.g., during default or expected operation; while a wear level or thickness of the drive wheels 68 is above a threshold). In such cases, a sensor (e.g. contact sensor or position sensor) and/or a scraper (or scraper blade) may be installed on the support beams 64. The sensor may be used to detect whether the support beams 64 contact or are within a threshold distance of the top surface of the rail 22. The sensor may generate a signal in response to the detected event, and the signal may indicate a corresponding (e.g., nearest) drive wheel 68 has experienced too much wear (e.g., the wear level or the thickness is below the threshold) during ride operations. The scraper or scraper blade may be used to clean the rail 22 to remove possible debris or fallen objects during ride operations to avoid potential halt/damage to the first platform drive wheel 68.

As illustrated, the jack 65 may have a pre-attached pad, which may prevent possible delamination (e.g., to the rail 22) during ride operations when one or more drive wheels 68 wear out or a similar situation occurs. In some cases, the jack 65 may be a portable jack for maintenance (e.g. used to support the frame 63 and other components while replacing the drive wheel 68).

Additionally, it should be appreciated that the operations of the first platform drive assembly 20 may be coordinated and controlled by a controller 144 (e.g., electronic controller). The controller 144 may control and coordinate the operations of the drive units 60. For example, the controller 144 may control the drive motors 69 and/or the brakes to start or stop the rotation of the first platform 12. In an embodiment, the controller 144 may adjust speed settings of the drive motors 69 to control a rotation speed of the first platform 12.

The controller 144 may include one or more processors 145, a memory device 146, and an input device 147. The processor(s) 145 may provide control signals to certain controllable devices and components (e.g., motors, actuators, brakes, or the like) associated with the first platform drive assemblies 20 and other relevant assemblies/systems. The processor(s) 145 may be configured to receive inputs via an input device 147 (e.g., from a ride operator; from riders; from a computing device) and to provide the control signals to the controllable devices and components in response to the inputs.

Further, the processor(s) 145 may receive a signal generated by a sensor in response to the detected event (e.g. one of the support beams 64 contacting or being within the threshold distance of the rail 22) during a ride operation. The processor(s) 145 may respond to the received signals. For example, if the ride operation is near an end, the processor(s) 145 may determine and/or send an instruction to the control system 44 that the ongoing ride operation may proceed until reaching the end. In an embodiment, where multiple sensors are installed (e.g., on multiple support beams 64), the processor(s) 145 may determine and/or instruct continuing or terminating the ride operation based on a number of support beams 64 in contact with or within the threshold distance of the rail 22. For example, if the processor(s) 145 receives a signal from one sensor indicating a contacting event has been detected during a ride operation, the processor(s) 145 may determine and/or send an instruction to the controller 44 that the ride operation may proceed. However, when the processor(s) 145 receives signals from both sensors installed on the paired support beams 64 of one drive unit 60 or from multiple sensors installed on multiple support beams 64 of multiple drive units 60, the processor(s) 145 may determine and/or send an instruction to the controller 44 that the ride operation should be terminated. In response, the controller 44 may instruct a suitable action, such as to maintain the ride operation, stop the ride operation, and/or provide a notification for repair (e.g., to a ride operator).

The memory device 146 may include one or more tangible, non-transitory, computer-readable media that store instructions executable by the processor(s) 145. For example, the memory device 146 may include random access memory (RAM), read only memory (ROM), rewritable non-volatile memory such as flash memory, hard drives, optical discs, and/or the like. Additionally, the processor(s) 145 may include one or more general purpose microprocessors, one or more application specific processors (ASICs), one or more field programmable gate arrays (FPGAs), or any combination thereof.

Figure 4:
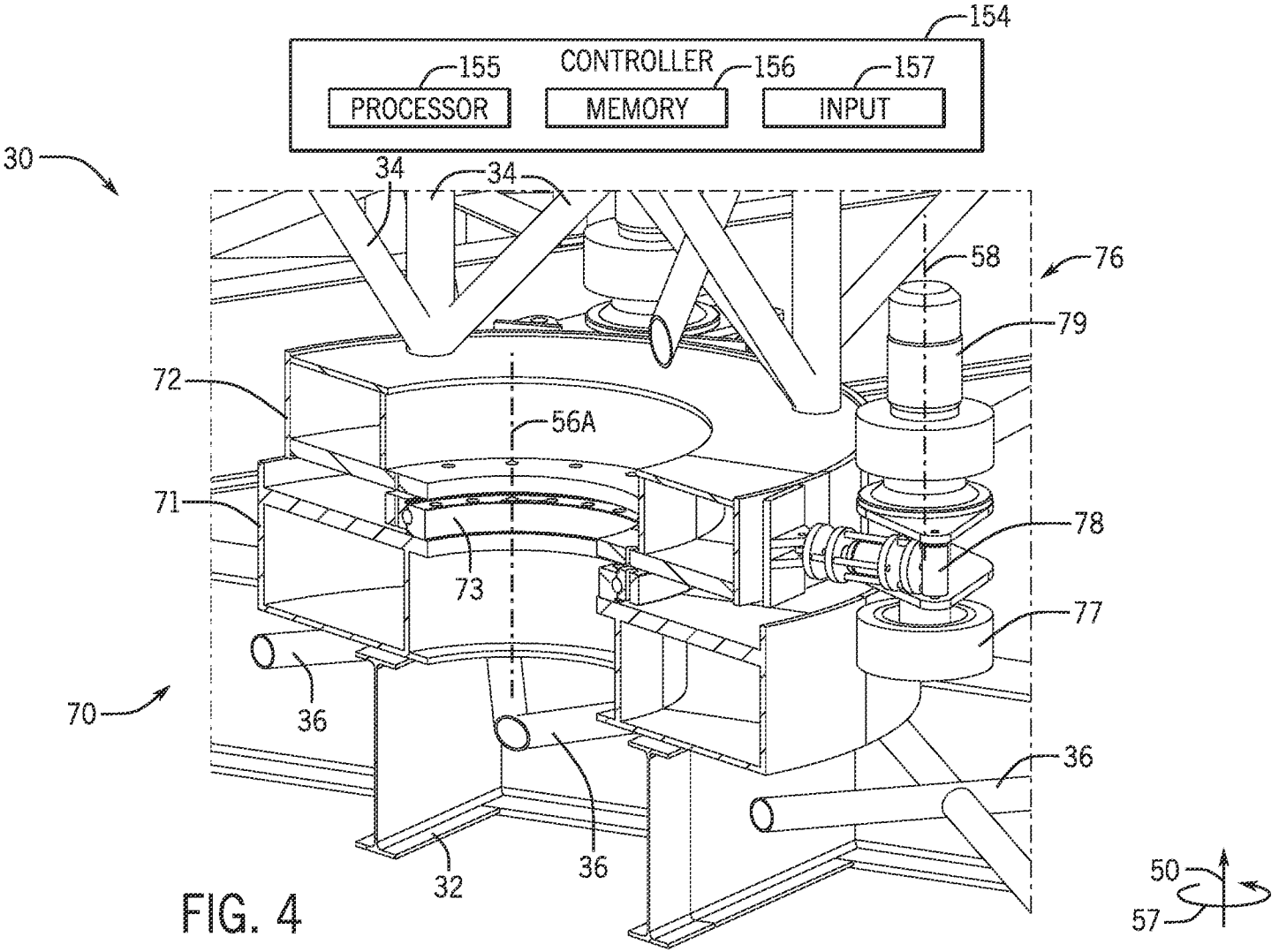
FIG. 4 is a cross-sectional perspective view of one of the second platform drive assemblies of FIG. 1, in accordance with an embodiment of the present disclosure.

FIG. 4 is a cross-sectional perspective view of one of the second platform drive assemblies 30, as described in FIG. 1. For example, the portion of the second platform drive assembly 30 shown here may be from one of the second platform drive assemblies 30 described previously. Each of the second platform drive assemblies 30 may be used to drive a corresponding second platform 14 to rotate about a respective second rotational axis (e.g., the second rotational axis 56A).

During ride operations, each second platform 14, a group of the multiple FIGS. 16B positioned on the second platform 14, and the second platform drive assembly 30 may rotate together in a circumferential direction (e.g., circumferential direction 57). During this rotation, each FIG. 16B in the group of multiple FIGS. 16B positioned on the second platform 14 may move up and down relative to the second platform 14 along a respective figure axis 55. Meanwhile, each FIG. 16B in the group of multiple FIGS. 16B may rotate about the respective figure axis 55.

As illustrated, the second platform drive assembly 30 shown here may include a plate assembly 70 and one or more drive wheel assemblies 76. The plate assembly 70 may provide a rotation base for the second platform 14 mounted on top of the plate assembly 70. The drive wheel assembly 76 may provide the drive force for the plate assembly 70.

The plate assembly 70 may include a fixed plate 71 (e.g., fixed to the radially-extending beam 32), a rotatable plate 72 (e.g., rotatable relative to the fixed plate 71), and a bearing plate 73 between the fixed plate 71 and the rotatable plate 72. The fixed plate 71 may be positioned on top of the radially-extending beam 32. Additionally, the fixed plate 71 may be connected to a corresponding first platform drive assembly 20 by one or more additional connection beams 36. The bearing plate 73 is placed under the rotatable plate 72 to distribute the load (e.g., combined weight from the second platform 14 and the group of the multiple FIGS. 16B positioned on the second platform 14) and/or transfer concentrated compressive forces between the fixed plate 71 and the rotatable plate 72. The rotatable plate 72 is used to drive the second platform 14 to rotate about a respective vertical axis (e.g., second rotational axis 56A) during ride operations.

Both the fixed plate 71 and the rotatable plate 72 may have radially-outer (e.g., donut-shaped, ring-shaped, annular) surfaces. In an embodiment, both the fixed plate 71 and the rotatable plate 72 may have hollow structural sections to provide a low-weight structure, thus increasing driving efficiency of the drive wheel assemblies 76 during ride operations.

In an embodiment, the fixed plate 71, the rotatable plate 72, and the bearing plate 73 may be concentric (e.g., centered about the second rotational axis 56A). The inner diameters of the fixed plate 71, the rotatable plate 72, and the bearing plate 73 may be same or similar to each other, while the outer diameters may be different. For example, the fixed plate 71 may have a larger outer diameter than the rotatable plate 72 and the bearing plate 73. The bearing plate 73 may have a smaller outer diameter than the fixed plate 71 and the rotatable plate 72.

The drive wheel assemblies 76 may include a drive wheel 77, a wheel holder 78, and a drive motor 79. Driven by the drive motor 79, the drive wheel 77 may be movable along the radially-outer surface of the fixed plate 71. The wheel holder 78, which may be placed between the drive wheel 77 and the drive motor 79, may be used to hold the drive wheel 77 onto the radially-outer surface of the fixed plate 71. The wheel holder 78 may have certain contact parts (e.g., extended from the main body of the wheel holder 78 toward the rotatable plate 72) that may contact the radially-outer surface of the rotatable plate 72. Therefore, rotation of the drive wheel 77 (e.g., about a rotational axis 58) may drive the rotatable plate 72 to rotate about the second rotational axis 56A, accordingly driving the second platform 14 to rotate about the second rotational axis 56A during ride operations.

It should be appreciated that the wheel holder 78 may contact the fixed plate 71 and the drive wheel 77 may move along the radially-outer surface of the rotatable plate 72. The drive motor 79 may be any type of electrical motor that generates the rotational force used to drive the drive wheel(s) 77 to rotate. Although not shown here, the drive wheel assemblies 76 may include other components, such as one or more brake units, one or more biasing members, one or more gearboxes, and the like.

Additionally, it should be appreciated that the operations of the second platform drive assemblies 30 may be coordinated and controlled by a controller 154 (e.g., electronic controller). The controller 154 may control and coordinate the operations of the plate assemblies 70 and drive wheel assemblies 76. For example, the controller 154 may control one or more drive motors 79 and/or associated brakes to start or stop one or more rotations of the second platforms 14. In an embodiment, the controller 154 may adjust speed settings of the drive motors 79 to control a rotational speed of the second platform 14.

The controller 154 may include one or more processors 155, a memory device 156, and an input device 157. The processor(s) 155 may provide control signals to certain controllable devices and components (e.g., motors, actuators, brakes,) associated with the second platform drive assemblies 30 and other relevant assemblies/systems. The processor(s) 155 may be configured to receive inputs via an input device 157 (e.g., from a ride operator; from a rider) and to provide the control signals to the controllable devices and components in response to the inputs. For example, during certain ride operations, one or more second platforms 14 may be reserved for special events (e.g. family rides) that allow adults to ride with children. Accordingly, certain FIGS. 16B may be modified to have double-seat features. The operator may use the controller 154 directly or indirectly (e.g., through the controller 44 that may provide access to the controller 154 remotely) to adjust the operations of the reserved second platforms 14 based on characteristics of the FIGS. 16B and/or preferences of the riders. For instance, the rotational speed of the reserved second platforms 14 may be adjusted lower or higher during a time window during ride operations based on the characteristics of the FIGS. 16B and/or preferences of the riders.

The memory device 156 may include one or more tangible, non-transitory, computer-readable media that store instructions executable by the processor(s) 155. The adjustable rotational speed of the reserved second platforms 14 may be stored in the memory device 156 so that the preferred operations related to the family ride events may be performed automatically via the processor(s) 155 with or without the operator's supervisions. The memory device 156 may include random access memory (RAM), read only memory (ROM), rewritable non-volatile memory such as flash memory, hard drives, optical discs, and/or the like. Additionally, the processor(s) 155 may include one or more general purpose microprocessors, one or more application specific processors (ASICs), one or more field programmable gate arrays (FPGAs), or any combination thereof.

Figure 5:
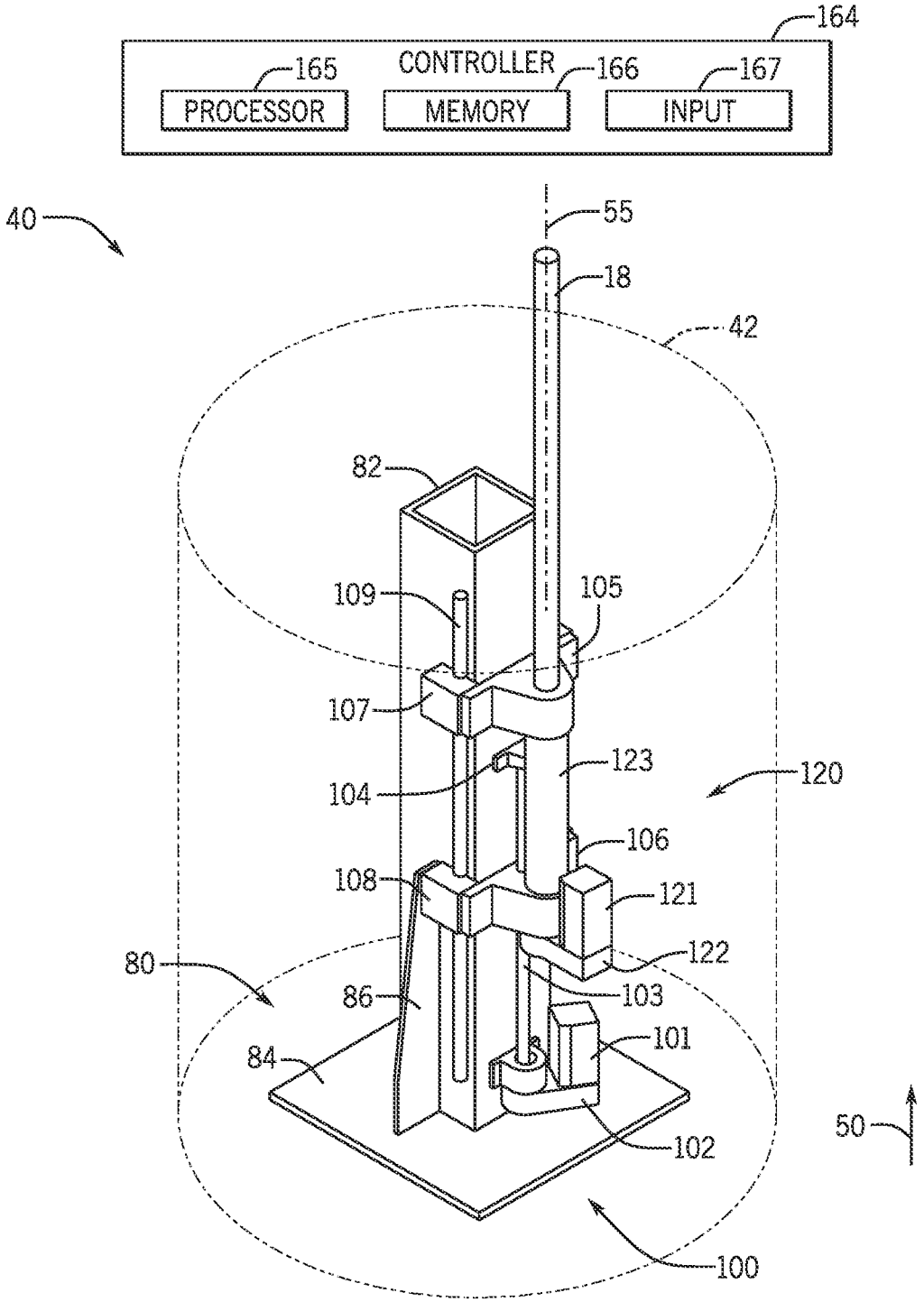
FIG. 5 is a perspective view of one of the figure drive assemblies of FIG. 1, in accordance with an embodiment of the present disclosure.

Turning to FIG. 5, a perspective view of one of the figure drive assemblies 40 is illustrated. As stated previously, each figure drive assembly 40 may be concealed inside the respective housing unit 42 that is located under the first platform 12 or the respective second platform 14. Each housing unit 42 may be attached to a bottom side of the first platform 12 or the respective second platform 14. Each pole 18 may extend from the connected housing unit 42 along the figure axis 55, through a respective opening in either the first platform 12 or one of the second platforms 14, to a corresponding FIG. 16.

A support assembly 80 may be used to provide support for the pole 18 and to provide mounting points for a lift assembly 100 and a rotation assembly 120. The lift assembly 100 may drive the pole 18 to move up and down along the figure axis 55 during ride operations. The rotation assembly 120 may drive the pole 18 to rotate about the figure axis 55 during ride operations. With the figure drive assembly 40 and the resulting increased operational flexibility of the carousel ride system 10, the ride guests may have a more enjoyable riding experience.

The support assembly 80 may include a post 82 mounted on a base plate 84. As shown, one or more ribs 86 may be installed (e.g., welded) between the lower portion of the post 82 and the base plate 84 to reinforce the joint between the post 82 and the base plate 84, therefore increasing the stability of the pole 18 and the corresponding FIG. 16 attached to the pole 18 during ride operations. The post 82 may have a hollow structural section to provide a low-weight structure, thus reducing the weight attached to the first platform 12 and the second platform 14.

The lift assembly 100 may include a lift motor 101 installed on a lift motor base 102. The lift motor base 102 may be mounted on the base plate 84. A threaded shaft 103 (e.g., ball screw) may be installed with one end rotatably coupled to the lift motor base 102, and another end rotatably coupled to a shaft bracket 104 that is mounted on the post 82. The threaded shaft 103 may be utilized in conjunction with bearings (e.g., ball bearings) to facilitate rotation of the threaded shaft 103. The lift motor 101 may be any type of electrical motor that generates the rotational force used to drive the threaded shaft 103 to rotate. The lift motor base 102 may include gears (e.g., spur gears and/or other types of gears) that may transfer motion (e.g., rotations) from an output shaft of the lift motor 101 to the threaded shaft 103. The threaded shaft 103 extend through a threaded opening in a mounting bracket 106, and the rotation of the threaded shaft 103 may drive linear movement of the mounting bracket 106 (and the components, such as the pole 18, supported on the mounting bracket 106) along the figure axis 55.

The threaded shaft 103 may thus be considered a linear actuator that translates rotational motion to linear motion with little friction. It should be appreciated that an additional and/or alternative driving mechanism may be utilized. For example, other types of linear actuators may be used to translate rotational motions to linear motions.

As shown, a pair of mounting brackets 105 and 106 are mounted on the support assembly 80. At least one of the mounting brackets (e.g., mounting bracket 106) may have the threaded opening to accept the threaded shaft 103. The mounting bracket 105 may be coupled to a pair of guides 107. Similarly, the mounting bracket 106 may be coupled to another pair of guides 108. Both the pair of guides 107 and the pair of guides 108 may move freely along a pair of rails 109 that are mounted on the post 82.

In addition to translational motions provided by the lift assembly 100, rotational motions may be provided by the rotation assembly 120. The rotation assembly 120 may include a rotation motor 121 installed on a rotation motor base 122. The rotation motor base 122 may be coupled to the mounting bracket 106 and to a sleeve 123 (e.g., rod). The rotation motor 121, the rotation motor base 122, the mounting bracket 106, the sleeve 123, and/or the pole 18 may translate along the figure axis 55 via operation of the lift assembly 100. Additionally, the sleeve 123 and the pole 18 coupled thereto may be driven to rotate about the figure axis 55 via operation of the rotation assembly 120. The rotation motor 121 may be any type of electrical motor that generates the rotational force used to drive the sleeve 123 to rotate. The rotation motor base 122 may include gears (e.g., spur gears and/or other types of gears) that may transfer rotation from an output shaft of the rotation motor 121 to the sleeve 123.

As the sleeve 123 is coupled to the pole 18, motions of the sleeve 123, including translational motions along the figure axis 55 and rotational motion about the figure axis 55, may be transferred to motions of the pole 18, which in turn may be transferred to motions of the FIG. 16 that is mounted on the pole 18. Therefore, in the carousel ride system 10, each FIG. 16 may raise, lower, and rotate independently during ride operations. It should be appreciated that the sleeve 123 and the pole 18 may be integrally formed with one another, or the rotation assembly 120 may be configured to drive the pole 18 without rotation of the sleeve 123, for example.

Additionally, it should be appreciated that the operations of the figure drive assembly 40 may be coordinated and controlled by a controller 164 (e.g., electronic controller). The controller 164 may control and coordinate the operations of the lift assembly 100 and rotation assembly 120. For example, the controller 164 may control the lift motor 101 to cause the corresponding FIG. 16 to start or stop moving up and down during ride operations. In an embodiment, the controller 154 may adjust speed settings of the rotation motor 121 to control rotational speeds and/or direction of the corresponding FIG. 16 during ride operations.

The controller 164 may include one or more processors 165 and a memory device 166. The processor(s) 165 may provide control signals to certain controllable devices and components (e.g., motors, actuators, brakes, or the like) associated with the individual lift and rotate system 40 and other relevant assemblies/systems. The processor(s) 165 may be configured to receive inputs via an input device 167 (e.g., from a ride operator, from riders, from a computing device) and to provide the control signals to the controllable devices and components in response to the inputs. For example, certain FIGS. 16 may be put offline for maintenance so that the individual lift and rotation may be disabled.

The memory device 166 may include one or more tangible, non-transitory, computer-readable media that store instructions executable by the processor(s) 165. In the example of figure maintenance described above, the identification of FIGS. 16 determined for maintenance may be stored in the memory device 166 so that these FIGS. 16 may be disabled during ride operations before maintenance commences. The memory device 166 may include random access memory (RAM), read only memory (ROM), rewritable non-volatile memory such as flash memory, hard drives, optical discs, and/or the like. Additionally, the processor(s) 165 may include one or more general purpose microprocessors, one or more application specific processors (ASICs), one or more field programmable gate arrays (FPGAs), or any combination thereof.

Figure 7:
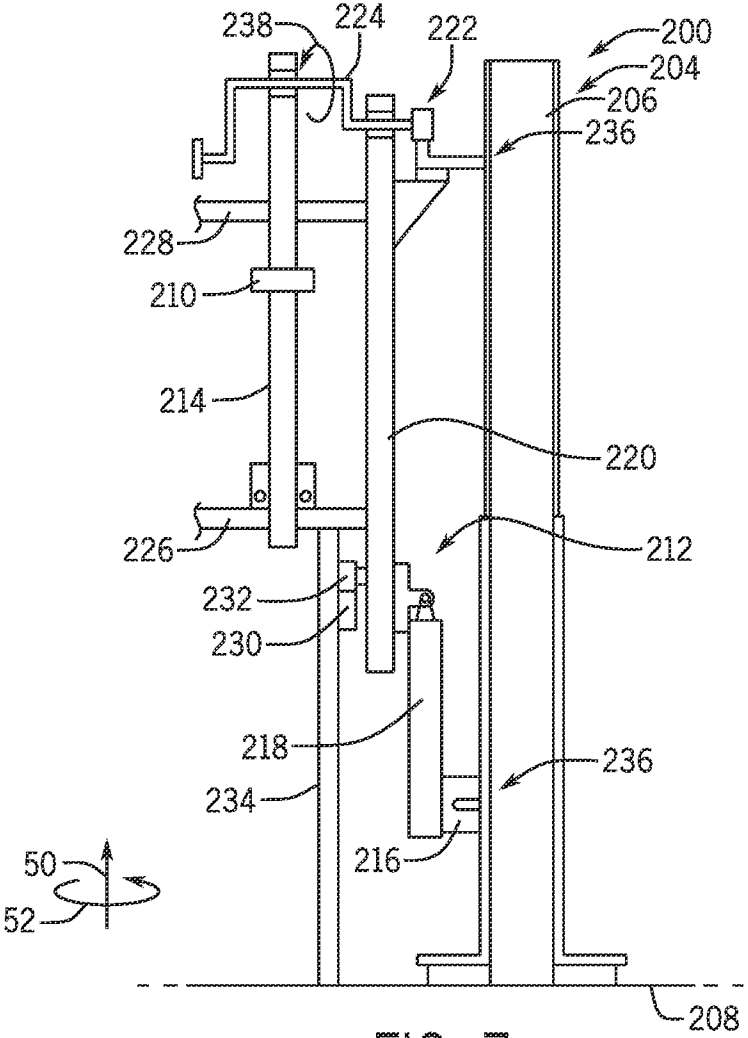
FIG. 7 is a cross-sectional side view of the central figure drive assembly of FIG. 6, wherein the central figure drive assembly is in a ride configuration, in accordance with an embodiment of the present disclosure.
Figure 6:
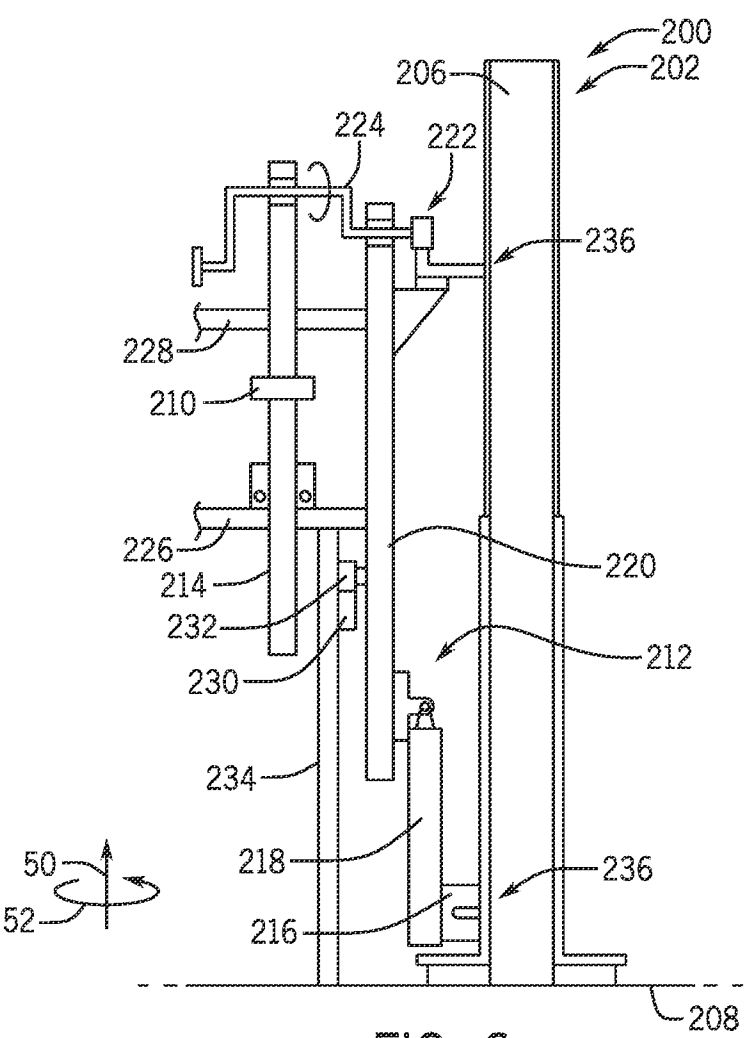
FIG. 6 is a cross-sectional side view of a central figure drive assembly that may be used in a carousel ride system, such as the carousel ride system of FIG. 1, wherein the central figure drive assembly is in a loading configuration, in accordance with an embodiment of the present disclosure.

FIGS. 6 and 7 are cross-sectional side views of an embodiment of a central figure drive assembly 200 that may be used in a carousel ride system, such as the carousel ride system 10 of FIG. 1. In FIG. 6, the central figure drive assembly 200 is in a loading configuration 202 (e.g., lowered or first configuration). In FIG. 7, the central figure drive assembly 200 is in a ride configuration 204 (e.g., raised or second configuration.

The central figure drive assembly 200 may include a center mast 206 that extends vertically upwardly from a floor 208 (e.g., ground). A FIG. 210 may be supported on a figure support assembly 212, and the FIG. 210 and the figure support assembly 212 may be relative to the center mast 206 and the floor 208 along the vertical axis 50. The figure support assembly 212 may include a figure support rod 214, a bracket 216, a first post 218, and/or a second post 220. The figure support assembly 212 may also include a gear assembly 222 and a crankshaft 224. The central figure drive assembly 200 may further include a platform 226 (e.g., the first rotatable platform) and/or a roof 228.

A motor 230 and/or a gear assembly 232 may be provided to drive the movement of the figure support assembly 212 and the FIG. 210 supported thereon. For example, the motor 230 and/or the gear assembly 232 may be positioned between and may contact a motor support rod 234 and a portion of the figure support assembly 212 to thereby drive the movement of the figure support assembly 212 and the FIG. 210 supported thereon. The bracket 216 and the gear assembly 222 may be coupled to the center mast 206 via respective splined interfaces 236, which may facilitate the movement in the vertical direction 50 and block movement in the circumferential direction 52 relative to the center mast 206.

In operation, the motor 230 may be controlled to adjust the central figure drive assembly 200 to the loading configuration 202 in which the FIG. 210 is positioned at a first distance above the platform 226 to enable a rider to board the FIG. 210. Then, upon initiation of the ride operation, the motor 230 may be controlled to adjust the central figure drive assembly 200 to the ride configuration 204 in which the FIG. 210 is positioned at a second distance above the platform 226 that is greater than the first distance to provide the rider with a more exciting ride experience. Then, in the ride configuration 204, the crankshaft 224 may be driven to rotate (e.g., via its own motor and/or the gear assembly 222), as shown by an arrow 238. The rotation of the crankshaft 224 may cause the FIG. 210 to move up and down relative to the platform 226. In this way, the central figure drive assembly 200 may enable the FIG. 210 to move through relatively large distances (e.g., more than 1 meter) relative to the platform 226 between the loading configuration 202 and the ride configuration 204 to provide for easy loading and to maintain a high vertical position throughout the ride operation, but also to move repeatedly through relatively small distances (e.g., less than 1 meter) relative to the platform 226 to provide an up and down motion (e.g., undulating motion) while the FIG. 210 is at the high vertical position during the ride operation. Furthermore, the center mast 206 may rotate in the circumferential direction 52 relative to the floor 208, which may drive rotation of the FIG. 210 and the figure support assembly 212 in the circumferential direction 52 relative to the floor 208 (e.g., via the splined interfaces 236). In this way, the rider may travel up and down along the vertical axis 50 and around in the circumferential direction 52 during the ride operation. It should be appreciated that multiple FIGS. 210 and their respective figure support assemblies 212 may be coupled to the center mast 206 at staggered positions (e.g., about a circumference of the center mast 206 and/or along the vertical axis 50). In such cases, the multiple FIGS. 210 may move from the loading configuration 202 to the ride configuration 204 together (e.g., at the beginning of the ride operation) and then may move via their respective crankshafts 224 throughout the ride operation. However, different operations and sequences of operations are envisioned. For example, certain FIGS. 210 may remain in the loading configuration 202 during the ride operation, such as in based on a rider selection or characteristics of the rider (e.g., a child).

It should be appreciated that the central figure drive assembly 200 may be utilized to drive figures in any of a variety of carousel ride systems. For example, the central figure drive assembly 200 may be utilized to drive the FIGS. 16A of the carousel ride system 10 of FIG. 1. In such cases, the center mast 206 may be positioned along the first rotational axis 54 of the first rotatable platform 12 shown in FIG. 1. Some or all of the FIGS. 16A of FIG. 1 may be coupled to the center mast 206 (e.g., at staggered positions about the circumference of the center mast 206) via their own figure support assembly 212, and the FIGS. 16A of FIG. 1 may rotate with the first rotatable platform 12 of FIG. 1 (e.g., via the splined interface 236) and may move up and down along the vertical axis 50 in the manner disclosed herein. It should be appreciated that the central figure drive assembly 200 may be utilized to drive the FIGS. 16B of the carousel ride system 10 of FIG. 1. In such cases, the center mast 206 may be positioned along the second rotational axis 56 of the second rotatable platform 14 shown in FIG. 1. Some or all of the FIGS. 16B of FIG. 1 may be coupled to (e.g., at staggered positions) the center mast 206 via their own figure support assembly 212, and the FIGS. 16B of FIG. 1 may rotate with the first rotatable platform 12 of FIG. 1 (e.g., via the splined interface 236) and may move up and down along the vertical axis 50 in the manner disclosed herein.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A drive system for a carousel ride system, the drive system comprising:

a plurality of figure drive assemblies configured to independently lift and rotate a plurality of figures of the carousel ride system, wherein each figure drive assembly of the plurality of figure drive assemblies comprises:

a rotation assembly comprising a rotation motor supported on a rotation base, a bracket coupled to the rotation base and slidingly coupled to a support post, and a sleeve coupled to the bracket and configured to couple to a pole of a respective figure of the plurality of figures; and a lift assembly comprising a lift motor supported on a lift base, a threaded shaft coupled to the lift base and extending through a threaded opening of the bracket, wherein operation of the rotation motor is configured to drive rotation of the sleeve, and wherein operation of the lift motor is configured to lift the rotation assembly.

2. The drive system of claim 1, comprising a first drive system configured to drive rotation of a first rotatable platform and the plurality of figures about a first rotational axis.

3. The drive system of claim 2, comprising a plurality of second drive assemblies configured to drive rotation of a plurality of second rotatable platforms and the plurality of figures about respective second rotational axes, wherein the plurality of second rotatable platforms are positioned within respective openings of the first rotatable platform and the plurality of figures extend over the plurality of second rotatable platforms.

4. The drive system of claim 3, comprising one or more processors configured to coordinate operation of the first drive system, the plurality of second drive assemblies, and the plurality of figure drive assemblies to maintain the plurality of figures in a forward-facing orientation relative to a direction of travel of the first rotatable platform during operation of the carousel ride system.

5. The drive system of claim 3, comprising a plurality of housings configured to couple to the plurality of second rotatable platforms, wherein each figure drive assembly of the plurality of figure drive assemblies is positioned within a respective one of the plurality of housings.

6. The drive system of claim 5, wherein each housing of the plurality of housings is attached to a first side of a respective second rotatable platform of the plurality of second rotatable platforms, wherein each figure of the plurality of figures is positioned on a second side of the respective second rotatable platform of the plurality of second rotatable platforms, and wherein the second side is opposite to the first side.

7. The drive system of claim 3, wherein at least one additional figure extends over the first rotatable platform.

8. The drive system of claim 1, wherein each figure drive assembly of the plurality of figure drive assemblies is configured to:

move the respective figure of the plurality of figures up and down along an axis of the respective figure; and drive the respective figure of the plurality of figures to rotate about the axis of the respective figure.

9. The drive system of claim 1, comprising one or more processors configured to provide a plurality of control signals to cause the plurality of figure drive assemblies to adjust the plurality of figures in accordance with a plurality of preferences associated with a plurality of riders associated with the plurality of figures, wherein the plurality of preferences indicates one or more preferred lift rates, one or more preferred lift heights, or both.

10. A drive system for a carousel ride system, the drive system comprising:

a plurality of figure drive assemblies configured to independently lift and rotate a plurality of figures relative to at least one rotatable platform, wherein each figure drive assembly of the plurality of figure drive assemblies comprises:

a rotation assembly comprising a rotation motor supported on a rotation base, a bracket coupled to the rotation base and slidingly coupled to a support post, wherein the bracket is configured to couple to a pole of a respective figure of the plurality of figures; and a lift assembly comprising a lift motor supported on a lift base, wherein operation of the rotation motor is configured to drive rotation of a sleeve, and wherein operation of the lift motor is configured to lift the rotation assembly.

11. The drive system of claim 10, wherein the lift assembly comprises a threaded shaft coupled to the lift base and extending through a threaded opening of the bracket.

12. The drive system of claim 10, comprising a housing mounted to a first side of a respective rotatable platform of the at least one rotatable platforms, wherein the respective figure of the plurality of figures is configured to extend over a second side of the respective rotatable platform of the at least one rotatable platform, and wherein the second side is opposite the first side.

13. The drive system of claim 12, wherein the pole of the respective figure of the plurality of figures is configured to extend from the housing and through a respective opening in the respective rotatable platform of the at least one rotatable platform.

14. The drive system of claim 12, wherein the housing is configured to conceal the rotation assembly and the lift assembly.

15. The drive system of claim 10, wherein the at least one rotatable platform comprises a first rotatable platform and a plurality of second rotatable platforms, and the drive system comprises:

a first drive assembly configured to drive rotation of the first rotatable platform and the plurality of figures about a first rotational axis; and a plurality of second drive assemblies, wherein each second drive assembly of the plurality of second drive assemblies is configured to drive rotation of a respective second rotatable platform of the plurality of second rotatable platforms and at least one figure of the plurality of figures about a respective second rotational axis.

* * * * *